US008662336B2

(12) United States Patent
Stowers

(10) Patent No.: US 8,662,336 B2
(45) Date of Patent: Mar. 4, 2014

(54) BAG SCAFFOLD

(71) Applicant: Zane Stowers, Tampa, FL (US)

(72) Inventor: Zane Stowers, Tampa, FL (US)

( * ) Notice: Subject to any disclaimer, the term of this patent is extended or adjusted under 35 U.S.C. 154(b) by 7 days.

(21) Appl. No.: 13/707,010

(22) Filed: Dec. 6, 2012

(65) Prior Publication Data

US 2013/0140308 A1 Jun. 6, 2013

Related U.S. Application Data

(60) Provisional application No. 61/567,251, filed on Dec. 6, 2011.

(51) Int. Cl.
*B65D 25/00* (2006.01)

(52) U.S. Cl.
USPC ..... 220/9.4; 206/600; 248/97; 220/475; 220/476

(58) Field of Classification Search
USPC ..... 220/9.4, 17.2; 248/97; 383/33
See application file for complete search history.

(56) References Cited

U.S. PATENT DOCUMENTS

| | | | | |
|---|---|---|---|---|
| 1,274,800 | A | 8/1918 | Sketteno | |
| 3,003,678 | A | 10/1961 | Chase | |
| 3,420,483 | A | 1/1969 | Stalker | |
| 3,502,291 | A | 3/1970 | Ackerman et al. | |
| 3,614,042 | A | 10/1971 | Jensen | |
| 3,915,329 | A | 10/1975 | Zaks | |
| 4,037,778 | A | 7/1977 | Boyle | |
| 4,281,813 | A * | 8/1981 | Garrity | 248/97 |
| 4,284,205 | A | 8/1981 | Hirata | |
| 4,890,652 | A | 1/1990 | Hoerner | |
| 4,940,200 | A | 7/1990 | Sawyer et al. | |
| 5,129,609 | A | 7/1992 | Tobin | |
| 5,285,988 | A | 2/1994 | Bogren | |
| D347,577 | S | 6/1994 | Dire | |
| 5,400,989 | A | 3/1995 | Gaskill | |
| D361,185 | S | 8/1995 | Seiler et al. | |
| D391,724 | S | 3/1998 | Blackburn | |
| 5,871,037 | A | 2/1999 | Feldt | |
| 6,007,030 | A | 12/1999 | Judge | |
| 6,065,512 | A | 5/2000 | Munn, II | |
| 6,227,439 | B1 | 5/2001 | Hansen | |
| 6,541,701 | B1 * | 4/2003 | Loose et al. | 174/521 |
| 6,659,407 | B2 | 12/2003 | Asaro | |
| 6,902,061 | B1 | 6/2005 | Elstone | |
| D523,604 | S | 6/2006 | Wiley | |
| 7,946,764 | B2 | 5/2011 | Sulpizio et al. | |
| 7,997,543 | B1 * | 8/2011 | Campbell | 248/97 |
| 2005/0224292 | A1 | 10/2005 | Rubang, Jr. | |
| 2007/0187558 | A1 | 8/2007 | Blodgett et al. | |
| 2009/0313951 | A1 | 12/2009 | Hanson et al. | |

* cited by examiner

*Primary Examiner* — David T. Fidei
*Assistant Examiner* — Raven Collins
(74) *Attorney, Agent, or Firm* — JP Webb; Jason P. Webb; Danny Y. H. Cheng

(57) ABSTRACT

There is a bag scaffold configured to support a flexible bag in an upright and open configuration. The bag scaffold includes a first wall member having a first end and a second end. The first wall member includes a plurality of panels coupled to each other in series by an integral leaf spring. The first wall member includes a first coupling structure and a second coupling structure and is configured to be able to selectably couple to the first coupling structure. The bag scaffold includes a second wall member that is substantially identical to the first wall member and is selectably coupled thereto at their respective first and second coupling structures.

17 Claims, 5 Drawing Sheets

BAG SCAFFOLD

CROSS-REFERENCE TO RELATED APPLICATIONS

This invention claims priority, under 35 U.S.C. §120, to the U.S. Provisional Patent Application No. 61/567,251 by Zane Stowers filed on Dec. 6, 2011, which is incorporated by reference herein in its entirety.

BACKGROUND OF THE INVENTION

1. Field of the Invention

The present invention relates to kitchen aids, specifically to a bag scaffold configured to support a flexible bag in an open and upright configuration.

2. Description of the Related Art

Storing materials in bags is done for varying purposes, including but not limited to food storage, shipping, and even creating building materials (sand bags, etc.). To optimize storage space and flexibility while minimizing weight and bulk, these bags are generally flexible and have little to no structure other than the minimum needed to contain their contents.

Accordingly, it is sometimes difficult to fill the bags, especially with fluid or fluid-like materials (sand, grains, etc.). Structures have been developed to facilitate use of these bags, including structures for the bags themselves.

A zipper storage bag or a slider storage bag is an inexpensive flexible rectangular storage bag, usually mainly transparent, made of PVC or similar plastic, which can be sealed and opened many times by a slider which works in a similar way to a zip fastener. The bags are made in many sizes and shapes. Many such bags are of food grade, suitable for food storage such as sandwiches, fruits, liquids, solids, etc. The bags may be made for freezer storage and air-tight storage.

Other structures have been developed to provide a support, or scaffolding, for the bags. In this manner, as a supported bag is being filled, the bag will not tip over. Also, this can remove the need to use ones hand(s) to stabilize the bag. Accordingly, the hand(s) may be used in the filling process for faster, easier, safer, cleaner, more comfortable, etc. filling and/or processing. These structures come in varying forms with varying benefits.

Some improvements have been made in the field. Examples of references related to the present invention are described below in their own words, and the supporting teachings of each reference are incorporated by reference herein:

U.S. Pat. No. 6,007,030, issued to Judge, discloses a trash bag holder and expanding form is made from a sheet of stiff material that has at least three panels to hold a bag in an erect condition and to expand the opening of the bag into a shape that will allow the user to fill the bag with leaves or trash without having to hold the bag. The panels are separated by parallel, vertically disposed score lines that act as fold lines or hinges between the panels of the holder. The holder can be formed from high density corrugated polyurethylene (HDPE) board, recycled plastic corrugated board that may have a lap joint sealed by a sonic weld. The panels are proportioned so that the sheet material can be folded flat with the panels lying against one another. When the invention is folded into its operational configuration, the score lines act as corners such that the form is tubular or U-shaped with open ends and braces may hold panels in extended opposing relationship.

U.S. Pat. No. 6,902,061, issued to Elstone, discloses a collapsible box for storing liquids, the box capable of being stacked while filled and then collapsed for convenient storage and return shipping when not filled. The box includes a base having a lip extending upwardly along the edges of the bottom panel. An upper sleeve is connected to the base by a base hinge, the upper panel being foldable by way of several other hinges to either an open or a closed position. A lid has a lip extending downwardly to selectively surround the top edges of the upper sleeve when the upper sleeve is in the open position, thereby forming an enclosure.

U.S. Pat. No. 6,659,407, issued to Asaro, discloses a collapsible trash bag stand having a sleeve-shaped body made from durable semi-rigid sheet material and having a plurality of punch-out, retainer tabs that snap into position to prevent the bag from slipping into the stand and to accommodate loading of multiple layers of trash bags at one time.

U.S. Patent Application Publication No. 2007/0187558, by Blodgett et al., discloses a food storage bag holder is configured to maintain a food storage bag in an open and upright configuration to facilitate filling the food storage bag with contents such as food. The holder has a body comprised of a cylinder or frame with a top rim adapted to frictionally engage a folded over top edge of the food storage bag to support it and hold it open. The body defines an interior cavity. The holder is sized to engage a food storage bag. The top rim is sized to engage a bag having a resealable closure. The bag is engaged by inserting the bag into the cavity defined by the body and folding the closure of the bag over the top rim of the holder. The top rim has an outer perimeter less than the perimeter of the mouth of the bag. For example, a circular top rim may have an outer diameter less than the quotient of the perimeter of the mouth of the bag divided by .pi.. The height h of the holder is less than the height measured from the bottom of the body of the bag to the bottom edge of the closure of the bag.

U.S. Patent Application Publication No. 2005/0224292, by Rubang Jr., discloses a collapsible box with an interlocking lip-sealable plastic bag as a liner is unfolded to open the sealable bag to permit oil from a crankcase to be ecologically removed during an oil change. When all of the oil has been removed, the bag is sealed and the box with the bag is transported to a disposal site where it may be safely handled. In one embodiment, the box with the bag is provided with a capped outlet port such that the oil from the bag can be removed by uncapping the outlet port where it may be made to drain into an approved receptacle. In another embodiment the bag is adhesively secured to the walls of the box so that the bag is supported when the box is opened and upright so as to be able to receive the draining oil. In a still further embodiment the bag is folded down over the box to overlap the upper portion of the box such that opening of the box provides an expanded aperture for the bag into which drained oil may be directed. The oil bag/box combination is designed to be collapsible so that it can be folded flat and stacked for easy storage. In another embodiment the box is provided with foldable handles to facilitate carrying.

The inventions heretofore known suffer from a number of disadvantages which include being limited in use, being difficult to use, being too bulky, being inefficient, being ineffective, being too expensive, being awkward to use, being expensive to manufacture, being difficult to manufacture, being prone to defect, being difficult to clean, being difficult to maintain, failing to resist changing forces from a contained bag during a filling process, being difficult to adjust to a storing configuration, being bulky to ship, requiring too many different parts, being too flexible along one or more geometric regions/planes/lines/etc., being unstable, being prone to breakage, being too complicated, having too many parts, having a large and/or complicated cleaning surface area, harboring germs, not being scalable to various sized projects, requiring the user to have physical contact with the material being disposed in the bag, requiring fill material to have contact with the scaffold structure during the fill process, being unsanitary, not being suitable for commercial use, not being suitable for industrial use, and/or not being suitable for home use.

What is needed is a bag scaffold that solves one or more of the problems described herein and/or one or more problems that may come to the attention of one skilled in the art upon becoming familiar with this specification.

SUMMARY OF THE INVENTION

The present invention has been developed in response to the present state of the art, and in particular, in response to the problems and needs in the art that have not yet been fully solved by currently available bag scaffolds or flexible bag supports. Accordingly, the present invention has been developed to provide an effective and efficient bag scaffold to support a flexible bag in an open and upright configuration.

According to one embodiment of the invention, there is a bag scaffold configured to support a flexible bag in an upright and open configuration. The bag scaffold may include a first wall member. The first wall member may include a first end and a second end that may be disposed opposite of each other. The first wall member may include a plurality of panels that may be coupled to each other in series by an integral leaf spring. The integral lead spring may be configured to bias the plurality of panels to a planar configuration. The plurality of panels may consist of three panels in series. Each of the plurality of panels may be more rigid than the leaf spring coupled thereto.

The first wall member may include a first coupling structure that may be extending from the first end at an angle to the natural plane of the wall, thereby extending into an interior of the scaffold. The first wall member may include a second coupling structure that may be extending from the second end at an angle to the natural plane of the wall such that the second coupling structure may extend into an interior of the scaffold. The second coupling structure may be configured to be able to selectably couple to the first coupling structure. The first wall may be substantially transparent and may include fill level markings. The first end and the second end may each include an elbowed protrusion from which the first coupling structure and the second coupling structure may extend respectively. Each of the elbowed protrusions may extend at an angle and distance sufficient to permit the first wall member and the second wall member to lay flat against each other without straining the coupling there between.

The bag scaffold may include a second wall member that may be substantially identical to the first wall member and may be selectably coupled thereto at their respective first and second coupling structures such that each first coupling structure may be coupled to each second coupling structure. The first wall member and the second wall member together may form a cylindrical envelope that may have a top aperture and a bottom aperture. The cylindrical envelope may have a hexagonal cross-section.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawing(s). It is noted that the drawings of the invention are not to scale. The drawings are mere schematics representations, not intended to portray specific parameters of the invention. Understanding that these drawing(s) depict only typical embodiments of the invention and are not, therefore, to be considered to be limiting its scope, the invention will be described and explained with additional specificity and detail through the use of the accompanying drawing(s), in which.

DETAILED DESCRIPTION OF THE INVENTION

Figure 1:
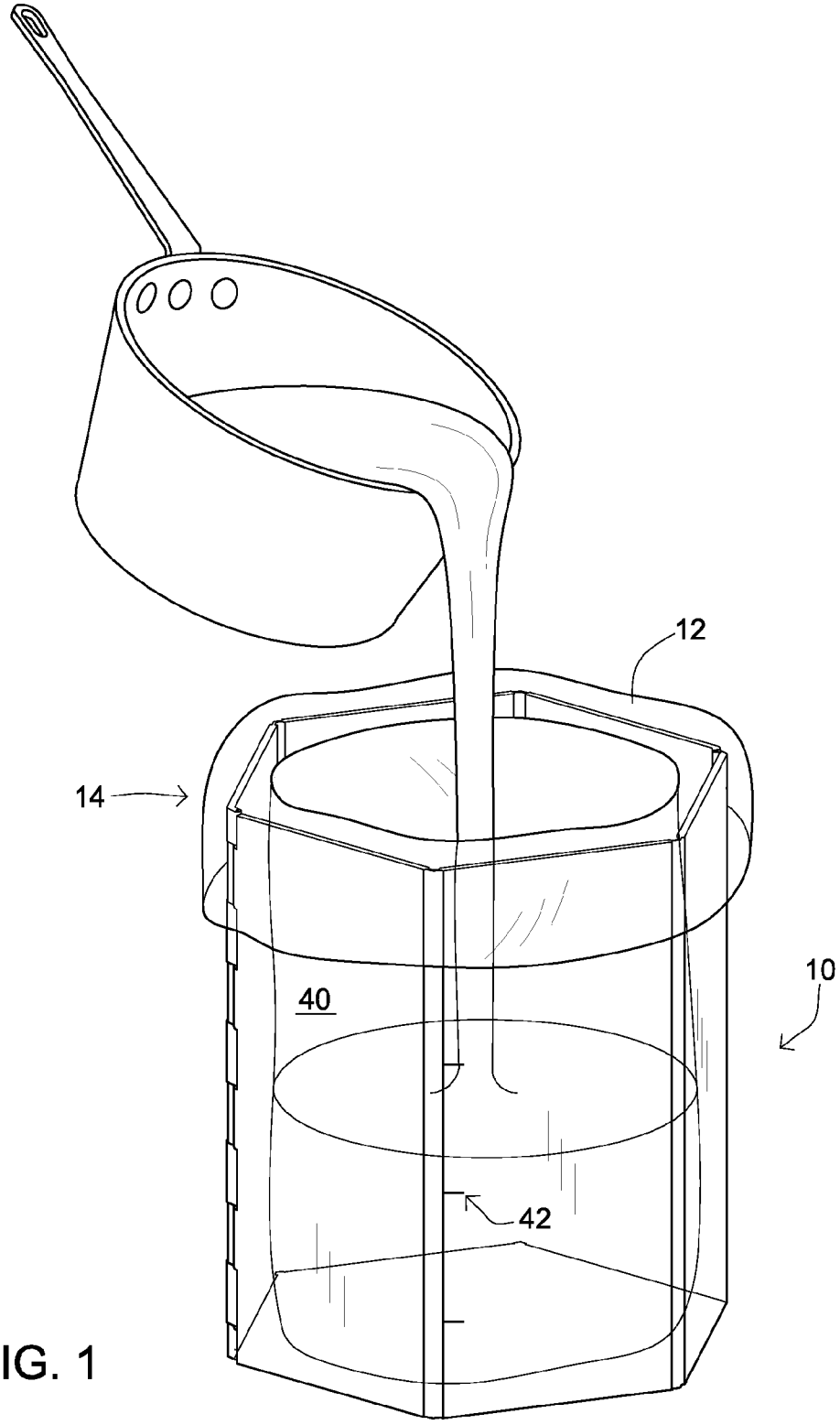
FIG. 1 is a perspective view of a bag scaffold in use, according to one embodiment of the invention.

For the purposes of promoting an understanding of the principles of the invention, reference will now be made to the exemplary embodiments illustrated in the drawing(s), and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to an "embodiment," an "example" or similar language means that a particular feature, structure, characteristic, or combinations thereof described in connection with the embodiment is included in at least one embodiment of the present invention. Thus, appearances of the phrases an "embodiment," an "example," and similar language throughout this specification may, but do not necessarily, all refer to the same embodiment, to different embodiments, or to one or more of the figures. Additionally, reference to the wording "embodiment," "example" or the like, for two or more features, elements, etc. does not mean that the features are necessarily related, dissimilar, the same, etc.

Each statement of an embodiment, or example, is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The features, functions, and the like described herein are considered to be able to be combined in whole or in part one with another as the claims and/or art may direct, either directly or indirectly, implicitly or explicitly.

As used herein, "comprising," "including," "containing," "is," "are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

FIG. 1 is a perspective view of a bag scaffold in use, according to one embodiment of the invention. There is shown a liquid being poured into a flexible bag 12 supported by a bag scaffold 10. The illustrated bag scaffold includes a pair of coupled wall members that are in an open mode forming a generally cylindrical hexagon structure inside which is disposed a flexible bag of a relatively similar size. The bag scaffold generally is transparent/translucent 40 and includes fill indicators 42 that assist in determining when a bag is properly filled.

The illustrated bag scaffold 10 is configured to support a flexible bag 12 in an upright and open configuration 14. The illustrated bag scaffold 10 is configured to support a flexible container in an upright position. The flexible container may be a zipper style bag (non-limiting example: a ZipLock brand plastic bag with a zipper coupling structure), a plastic bag, a soft plastic container, woven bag, satchel and/or etc. configured to store food, fluids, grain, sand, granules, and/or etc. and composites thereof. The illustrated flexible bag includes a selectably sealable aperture disposed on a side and is configured to hold and store a liquid or item.

Figure 4:
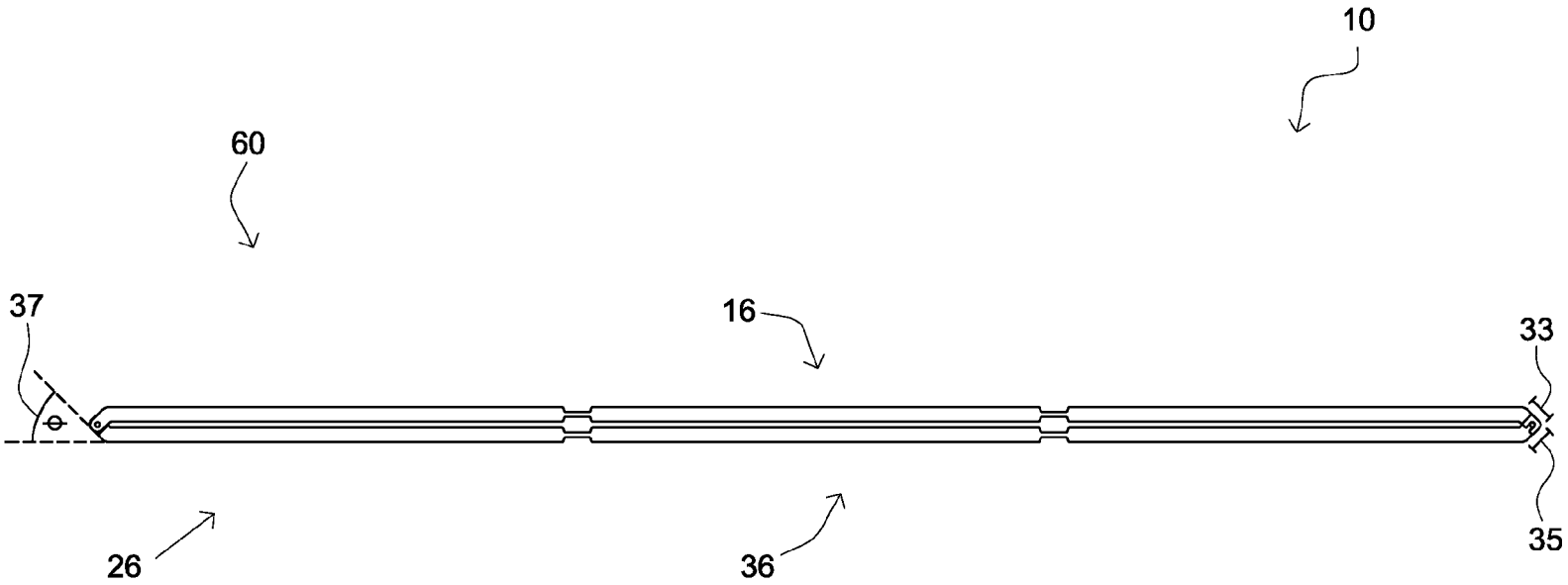
FIG. 4 is a top plan view of a bag scaffold in a flattened mode, according to one embodiment of the invention.

According to one embodiment of the invention, there is a bag scaffold 10 configured to support a flexible container 12 in an upright position 14 when in use. The bag scaffold 10 is generally configured to fold flat when not in use, as illustrated in FIG. 4. The bag scaffold 10 is sized and shaped to support the flexible container 12, when the flexible container 12 is disposed therein. The bag scaffold 10 is sized and shaped to be slightly wider and/or slightly taller than the flexible container 12 such that the flexible container 12 may be disposed in an interior of the bag scaffold 10. The bag scaffold 10 includes a top aperture and a bottom aperture, wherein the bag scaffold 10 is configured to receive the flexible container 12 therethrough.

In operation, a user opens the bag scaffold from a flat storage mode to an open usage mode and places the opened bag scaffold upright on a surface. The user then places a flexible bag therein and opens the flexible bag such that the walls of the flexible bag and placed generally next to the walls of the bag scaffold, thereby forming an open container ready to receive contents therein. The user then fills the flexible bag with a material, generally a fluid, granular material, or composite mixture, such as but not limited to food, drink, and the like. As the flexible bag fills it further presses against the walls in a manner consistent with the forces applied to it during filling.

Without the bag scaffold, the flexible bag would either deform and cease to be easily filled, or it would tip and spill. The bag scaffold advantageously supports the bag during this process. Generally, once the flexible bag is filled it can either support itself or can be closed so that when the bag scaffold is removed, it may continue to function as desired. Because the illustrated bag scaffold is biased to a flat configuration (See FIG. 4) instead of the open configuration of FIGS. 1 and 5, the bag scaffold resists further expansion of the structure and thereby provides an opposing force to the expanding and/or tipping bag inside the structure. This reduces the likelihood that the bag will shift or tip during filling. If the bag shifts or tips during filling then material being poured therein may miss the fill aperture of the bag and cause an undesired mess.

Further, the bias of the structure provides a gentle orthogonal pressure to the surface on which the structure rests. This generally increases stability of the structure itself, especially wherein the surface is a high friction surface such as but not limited to carpet, rubber, textured, and the like and combinations thereof.

Advantageously, the bag scaffold illustrated and/or described herein may be stored flat, such as but not limited to in a drawer or cabinet; facilitates usage of flexible bags by those who have particular handicaps or difficulties with the same; speeds up food preparation and cleanup for food service professionals; makes it much easier to fill flexible bags to and/or near to their ultimate capacity; permits filling of flexible bags with just one hand; protects flexible bags from damage; and operates in a manner that does not require contact with food, thereby promoting cleanliness and food safety. Such a bag scaffold is of particular benefit for those practicing bulk cooking and/or personal food storage, thereby permitting rapid, clean, safe and easy transferal of foodstuffs from cooking devices to storage devices. While particular emphasis is placed herein on food and drink, it is contemplated that the invention may be used in other industries such as but not limited to medical, industrial, manufacturing, organizing, child-care, construction, and the like and combinations thereof.

There may be a bag scaffold that includes a pair of coupled wall members that are substantially identical to each other, wherein each wall member may be formed by a single mold (injection mold, press mold, etc.). In a coupled mode, each wall member would be coupled to the other at two opposite regions and the coupling structures therebetween would generally be free-swinging coupling structures that would not bias the wall members at any particular angle. The wall members would include one or more bias members that would tend to induce the coupled wall members to be in a flattened mode with a very sharp angle of connection at each of the opposite regions. Accordingly, a single mold may be used to create all that is necessary for the assembled bag scaffold and assembly is simply a matter of coupling any two wall members together. In such a bag scaffold, the bias members of the wall members would be integral to the structure and would generally be embodied by leaf springs that consist of thinner leaf spring regions between thicker panel regions. Such a structure may include three panels, thereby forming a hexagonal shape when wall members are coupled and positioned in an open mode.

In one non-limiting embodiment, there is a set of panels coupled together in a generalized ring/toroid shaped apparatus. The panels may be of identical shape and/or size or may be of different sizes. There may be any number of panels and/or there may be six panels such that when coupled together in a general toroid the connected panels have a hexagonal (or octagonal, heptagonal, etc.) cross-section. Panels may be coupled together and/or may be folded, thereby forming separate and/or sub-panels that may be coupled and/ or adjacent. Panels may be coupled by spring-like structures (bias members), such as but not limited to leaf springs, coil springs, compression springs, torsion springs, extension springs, volute springs, drawbar springs, and/or magazine springs and the like and combinations thereof. Such bias members may have a standard linear force response (force-displacement response) within operational ranges and/or may have a force response that is non-linear within operational ranges such as but not limited to force responses that are exponential, stepped, regressive, and/or the like and combinations thereof and may include special springs and/or combinations of springs that function accordingly.

Panels may be coupled in manners diverse from couplings between other, even adjacent, panels. There may be couplings between panels such that the formed toroid is biased towards a particular mode, such as but not limited to a flattened mode, an open mode, a partially opened mode, a compressed mode and/or the like and combinations thereof. Wherein a formed toroid is biased towards a flattened mode it may provide additional support against outward directed forces that accumulate as a flexible bag is filled therein while also advantageously remaining in a flattened mode during storage and non-use.

In another embodiment, there are a set of panels that are generally equal in width and form a generally hexagonal ring wherein the first and fourth vertices are generally unbiased or biased (using a bias member at or about the first and fourth vertices) towards smaller interior angles, such as but not limited to less than about 90, 80, 75, 70, 65, 60, 55, 50, 45, 40, 35, 30, 25, 20, 15, 10, and/or 5 degrees (having structure and/or lacking structure that thereby causes the same such as but not limited to the structures described herein) and the remaining vertices are biased towards a flattening of the angles between adjacent panels, such as but not limited to interior angles greater than about 90, 95, 100, 105, 110, 115, 120, 125, 130, 135, 140, 145, 150, 155, 160, 165, 170, 175, and/or 180 degrees (having structure and/or lacking structure that thereby causes the same such as but not limited to the structures described herein), thereby forming an openable hexagonal channel that may also lie flat when so allowed. Such a channel may be formed of panels that are sufficiently transparent to permit viewing of a flexible bag therethrough in sufficient detail that information about the degree of filling may be observed. Such a channel may further include one or more markings, indicators, or the like to permit measurement and/or comparison and/or contrast to what may be viewed/observed therethrough.

There may be one or more structures coupled to and/or extending from one or more of the panels that may facilitate in holding panels together, apart, and/or altering one or more modes of positional bias. As a non-limiting example, there may be a clip coupled near an edge of a panel that may operate to clip two adjacent panels together in a flattened mode; clip them together in a mode that restricts the angles between the panels to a particular minimum, maximum, or combination; and/or a clip that causes a bias member to operationally engage and/or disengage between panels and thereby alter a bias between the panels.

In another embodiment, there may be one or more hinges coupling adjacent panels. Such hinges may operate in a standard fashion and/or may operate in a diverse manner. Hinges between a particular pair of hinges may operate differently from hinges of other panels on the same channel. Hinges may include one or more structures configured to lock panels into one or more particular angular orientations, such as but not limited to a hinge that has a strong bias to a flattened and/or a zero interior angle position (or other angular position, such as but not limited to those described herein) while at and/or near such a position, but a much smaller or insignificant bias at angles far from such positions (greater than about 1, 2, 3, 4, 5, 8, 10, 15, and/or 20 degrees from such positions) thereby permitting the structure to "snap" to a desired position when close to the desired angle and yet when far from the desired angle to not migrate theretoward. Such may include one or more bias members that automatically engages/disengages operationally when close/far from the desired angle.

Figure 2:
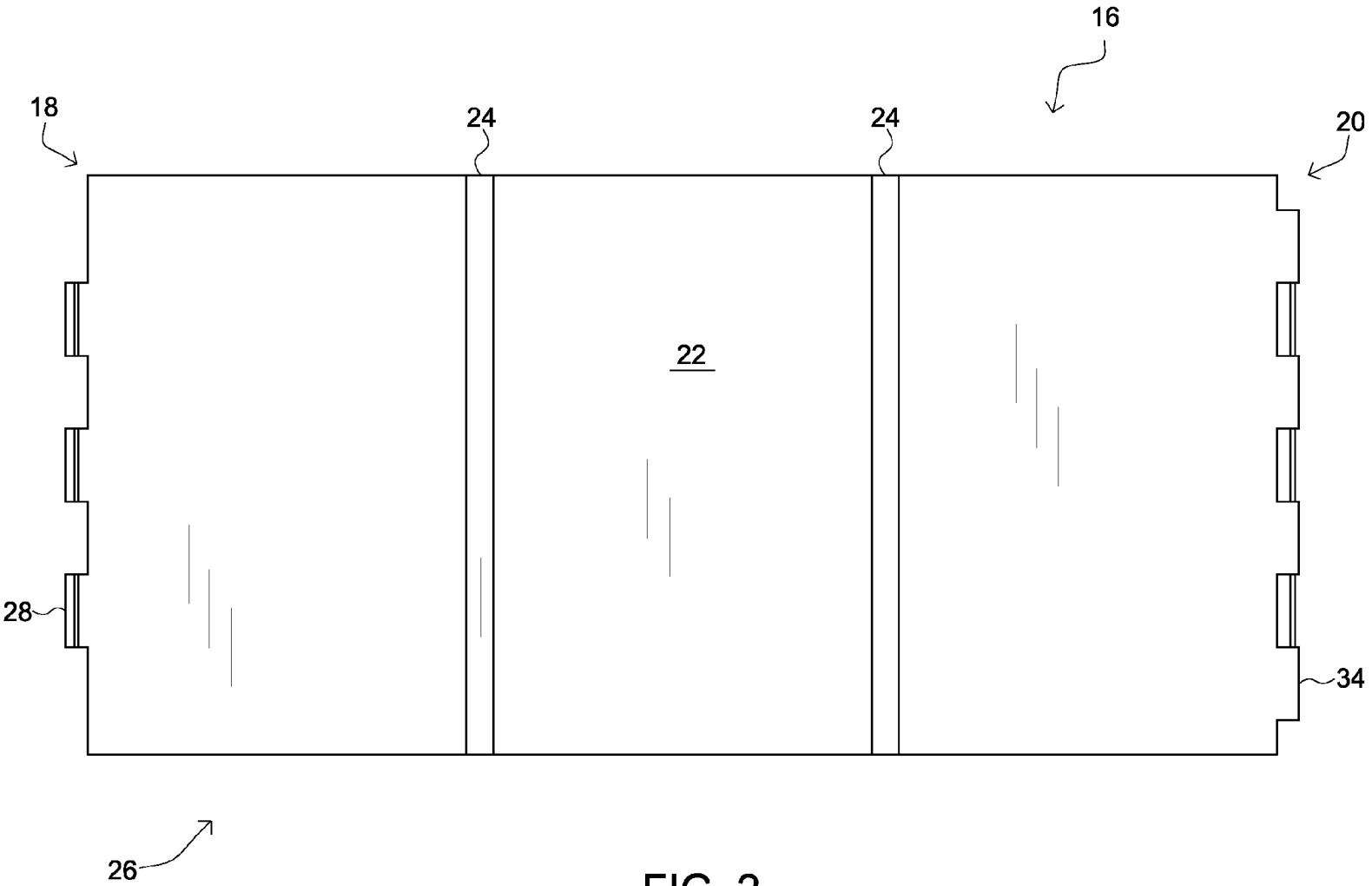
FIG. 2 is a side elevational view of a first wall member of a bag scaffold, according to one embodiment of the invention.

FIG. 2 is a side elevational view of a first wall member of a bag scaffold, according to one embodiment of the invention. There is shown a first wall member 16 having a first end 18, a second end 20, a plurality of panels 22, a first coupling structure 28, and a second coupling structure 34.

The illustrated first wall member 16 includes a first end 18 and a second end 20 that are disposed opposite of each other. The first wall member 16 includes a plurality of panels 22 coupled to each other in series by an integral leaf spring 24. The integral lead spring 24, or a bias member, is configured to bias the plurality of panels 22 to a planar configuration 26. The illustrated plurality of panels 22 consists of three panels in series. Each of the illustrated plurality of panels 22 are substantially more rigid than the leaf spring 24 coupled thereto. Accordingly, when in an open configuration, the panels form generally straight regions with bending in the leaf springs allowing angle changes between adjacent panels. In the illustrated example, the leaf springs extend the entire height of the adjacent panels.

The first wall member 16 includes a first coupling structure 18 extending from the first end 18. The first wall member 16 includes a second coupling structure 34 extending from the second end 20. The second coupling structure 34 is configured to be able to selectably couple to the first coupling structure 28. The illustrated coupling structures 18 and 34 are extended tongue and groove coupling devices that are shaped and positioned to mate together. In particular, the illustrated second coupling structure is a clip/hook structure that snaps over and around the entrapped bar member of the first coupling structure 18. Each of the illustrated coupling structures include a protrusion extending from the associated panels.

Figure 3:
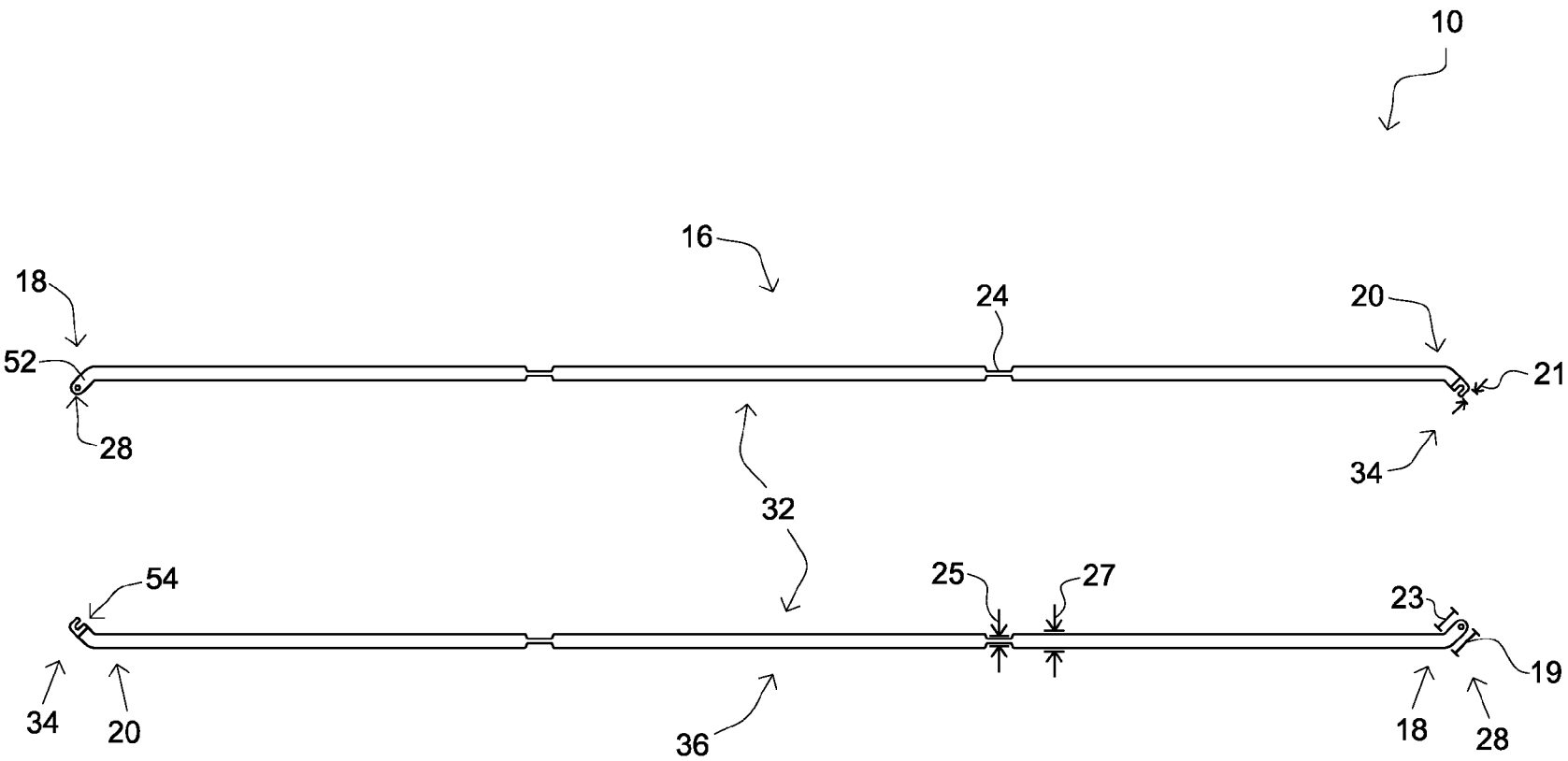
FIG. 3 is a top plan view of a pair of uncoupled wall members of a bag scaffold, according to one embodiment of the invention.

FIG. 3 is a top plan view of a bag scaffold, according to one embodiment of the invention. There is shown a bag scaffold 10 including a first wall member 16 and a second wall member 36.

The illustrated bag scaffold 10 is configured to support a flexible bag in an upright and open configuration. The bag scaffold 10 includes a first wall member 16. The first wall member 16 includes a first end 18 and a second end 20 that are disposed opposite of each other. The first wall member 16 include a plurality of panels coupled to each other in series by an integral leaf spring or bias member. The integral lead spring is configured to bias the plurality of panels to an illustrated planar configuration. The plurality of panels consists of three panels in series. Each of the plurality of panels is more rigid than the leaf spring or bias member coupled thereto. In the illustrated example, this is performed by having a substantial difference in the thickness of the corresponding structures while using a material that is elastic (plastic, generally) but rigid under normal conditions. In particular, the thickness 25 of the leaf spring region 24 is substantially less than the thickness 27 of the adjacent panel(s).

The illustrated first wall member 16 includes a first coupling structure 28 extending from the first end 18 at an angle to the natural plane of the wall, thereby extending into an interior 32 of the bag scaffold 10. The first wall member 16 includes a second coupling structure 34 extending from the second end 20 at an angle 37 (See FIG. 4) to the natural plane of the wall such that the second coupling structure 34 extends into the interior 32 of the scaffold 10. The second coupling structure 34 is configured to be able to selectably couple to the first coupling structure 28 of a second wall member 36. The illustrated coupling members extend from the associated panels at distances 19 and 23 that may be measured from an interior of the wall member as shown in element 23 or from an exterior as in element 19 of the figure. Regardless, the combination of the structure of the coupling members, the angle of protrusion and the distance of protrusion may be selected to impart fitting characteristics to the wall members such that when coupled together they may have a determined range of motion and other characteristics of fit.

The illustrated second coupling structure 34 at the second end 20 includes a thickness 21 that is substantially similar to the thickness 27 of the plurality of panels. The thickness 21 is configured to match a thickness of the first coupling structure 18 configured to selectably couple thereto.

The illustrated first end 18 and the second end 20 each include an elbowed protrusion 52 from which the first coupling structure 28 and the second coupling structure 34 extend respectively therefrom. Each of the elbowed protrusions 52 extends at an angle and distance 54 sufficient to permit the first wall member 16 and the second wall member 36 to lay flat against each other without straining the coupling there between.

The bag scaffold 10 includes a second wall member 36 that is substantially identical to the first wall member 16 and is selectably coupled thereto at their respective first and second coupling structures 28, 34 such that each first coupling structure 28 is coupled to each second coupling structure 34.

FIG. 4 is a top plan view of a bag scaffold, according to one embodiment of the invention. There is shown a bag scaffold 10 including a first wall member 16 coupled to a second wall member 36 in a closed configuration 60.

The illustrated bag scaffold includes a first wall member 16 and a second wall 36. The first wall member 16 and the second wall member each include a plurality of panels that are coupled to each other in series by an integral leaf spring. The integral lead spring is configured to bias the plurality of panels to a planar configuration 26. The plurality of panels consists of three panels in series. Each of the plurality of panels are more rigid than the leaf spring coupled thereto. The second wall member 36 is substantially identical to the first wall member 16 and is selectably coupled thereto. The wall members 16 and 36 are in a flat mode and include coupling structures that are at lengths 33 and 35 and angles 37 that permit the wall members 16 and 36 to lie flat against each other when in a flat mode, accordingly maximizing shipping characteristics even when assembled. It is common for products to require assembly after shipping in order to reduce shipping costs and this increases costs to the consumer because of the cost of assembly. In the presently illustrated case, shipping characteristics are maximized while eliminating the need for post-shipping assembly.

Figure 5:
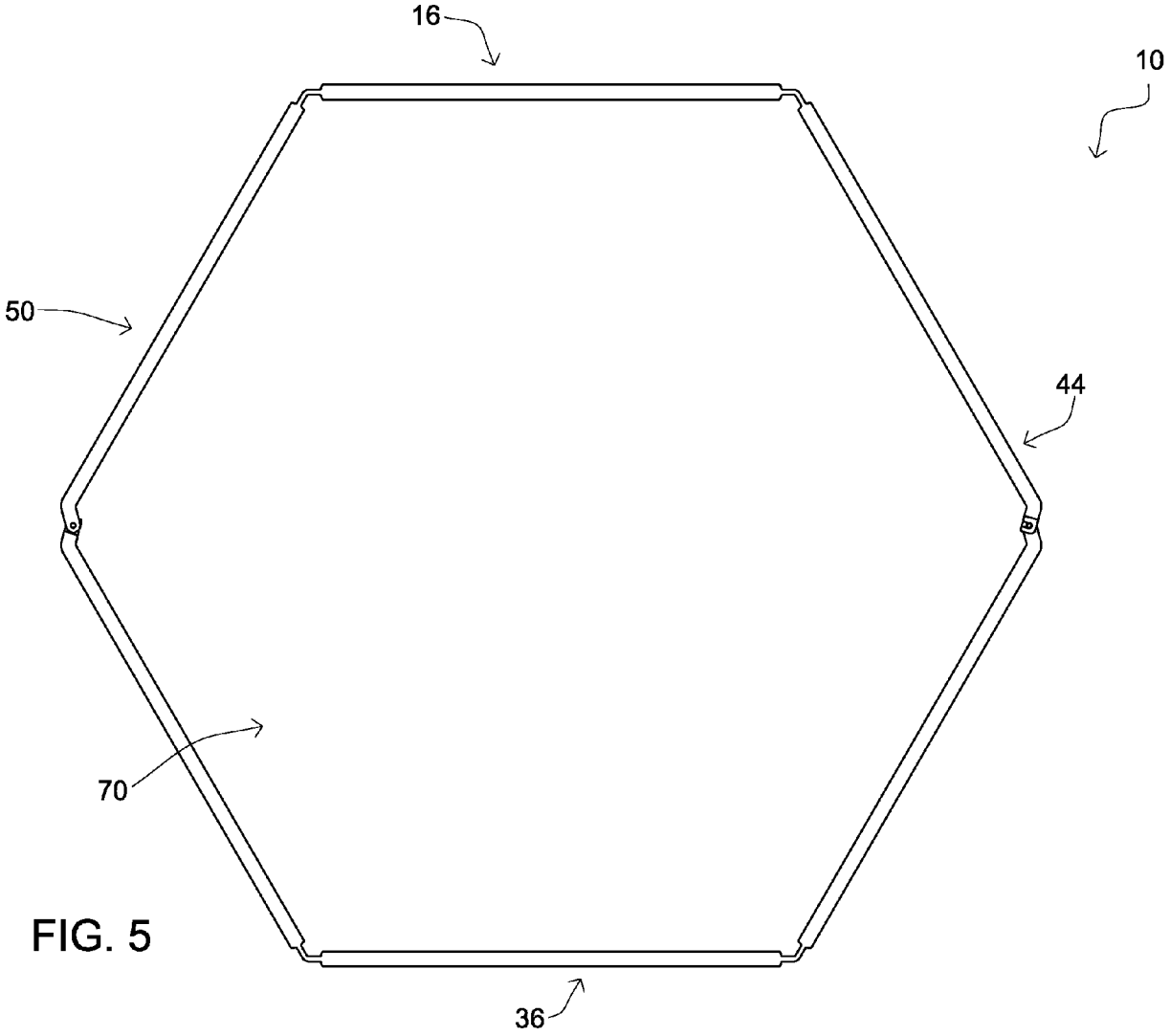
FIG. 5 is a top plan view of bag scaffold in an open mode, according to one embodiment of the invention.

FIG. 5 is a top plan view of bag scaffold, according to one embodiment of the invention. there is shown a bag scaffold 10 including a first wall member 16 coupled to a second wall member 36 in an open configuration 70.

The illustrated bag scaffold 10 includes a first wall member 16 and a second wall 36. The second wall member 36 is substantially identical to the first wall member 16 and is selectably coupled thereto. The first wall member 16 and the second wall member 36 together form a cylindrical envelope 44 having a top aperture and a bottom aperture. The cylindrical envelope 44 includes a hexagonal cross-section 50.

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

For example, although the figures illustrate generally symmetrical coupling structures, plethoric asymmetrical coupling structures may be used while still achieving one or more of the benefits of the present invention.

Additionally, although the figures illustrate particular coupling structures, other coupling/mating structures are contemplated, including but not limited to hook and loop, snaps, buttons, clips, hooks, magnets, friction fittings, and the like and combinations thereof.

It is also envisioned that bias members other than integral leaf springs may be used, including but not limited to non-integral bias members, coil-type springs, torsion springs, and the like and combinations thereof.

It is expected that there could be numerous variations of the design of this invention. A non-limiting example is that the panels may be other than the rectangular shapes illustrated.

Finally, it is envisioned that the components of the device may be constructed of a variety of materials, including but not limited to metal, plastic, rubber, ceramic, woven material, fibers, composites, and/or combinations thereof.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims. Further, it is contemplated that an embodiment may be limited to consist of or to consist essentially of one or more of the features, functions, structures, methods described herein.

What is claimed is:

1. A bag scaffold configured to support a flexible bag in an upright and open configuration, comprising:

a) a first wall member, including:

a1) a first end and a second end disposed opposite of each other;

a2) a plurality of panels coupled to each other in series by an integral leaf spring configured to bias the plurality of panels to a planar configuration;

a3) a first coupling structure extending from the first end at an angle to the natural plane of the wall, thereby extending into an interior of the scaffold; and a4) a second coupling structure extending from the second end at an angle to the natural plane of the wall such that the second coupling structure extends into an interior of the scaffold; wherein the second coupling structure is configured to be able to selectably couple to the first coupling structure; and b) a second wall member substantially identical to the first wall member and selectably coupled thereto at their respective first and second coupling structures such that each first coupling structure is coupled to each second coupling structure.

2. The scaffold of claim 1, wherein the plurality of panels consists of three panels in series.

3. The scaffold of claim 1, wherein the first wall is substantially transparent and includes fill level markings.

4. The scaffold of claim 1, wherein each of the plurality of panels is more rigid than the leaf spring coupled thereto.

5. The scaffold of claim 1, wherein the first wall member and the second wall member together form a cylindrical envelope having a top aperture and a bottom aperture.

6. The scaffold of claim 5, wherein the cylindrical envelope has a hexagonal cross-section.

7. The scaffold of claim 1, wherein the first end and the second end each include an elbowed protrusion from which the first coupling structure and the second coupling structure extend respectively.

8. The scaffold of claim 7, wherein each of the elbowed protrusions extend at an angle and distance sufficient to permit the first wall member and the second wall member to lay flat against each other without straining the coupling there between.

9. A bag scaffold configured to support a flexible bag in an upright and open configuration, comprising:

a) a first wall member, including:

a1) a first end and a second end disposed opposite of each other;

a2) a plurality of panels coupled to each other in series by a bias member configured to bias the plurality of panels to a planar configuration;

a3) a first coupling structure extending from the first end, thereby extending into an interior of the scaffold; and a4) a second coupling structure extending from the second end at an angle to the natural plane of the wall such that the second coupling structure extends into an interior of the scaffold; wherein the second coupling structure is configured to be able to selectably couple to the first coupling structure; and b) a second wall member substantially identical to the first wall member and selectably coupled thereto at their respective first and second coupling structures such that each first coupling structure is coupled to each second coupling structure.

10. The scaffold of claim 9, wherein the plurality of panels consists of three panels in series.

11. The scaffold of claim 10, wherein the first wall is substantially transparent and includes fill level markings.

12. The scaffold of claim 11, wherein each of the plurality of panels is more rigid than the bias member coupled thereto.

13. The scaffold of claim 12, wherein the first wall member and the second wall member together form a cylindrical envelope having a top aperture and a bottom aperture.

14. The scaffold of claim 13, wherein the cylindrical envelope has a hexagonal cross-section.

15. The scaffold of claim 14, wherein the first end and the second end each include an elbowed protrusion from which the first coupling structure and the second coupling structure extend respectively.

16. The scaffold of claim 15, wherein each of the elbowed protrusions extend at an angle and distance sufficient to permit the first wall member and the second wall member to lay flat against each other without straining the coupling there between.

17. A bag scaffold configured to support a flexible bag in an upright and open configuration, comprising:

a) a first wall member, including:

a1) a first end and a second end disposed opposite of each other;

a2) a plurality of panels coupled to each other in series by an integral leaf spring configured to bias the plurality of panels to a planar configuration; wherein the plurality of panels consists of three panels in series; wherein each of the plurality of panels is more rigid than the leaf spring coupled thereto;

a3) a first coupling structure extending from the first end at an angle to the natural plane of the wall, thereby extending into an interior of the scaffold; and a4) a second coupling structure extending from the second end at an angle to the natural plane of the wall such that the second coupling structure extends into an interior of the scaffold; wherein the second coupling structure is configured to be able to selectably couple to the first coupling structure; wherein the first wall is substantially transparent and includes fill level markings; wherein the first end and the second end each include an elbowed protrusion from which the first coupling structure and the second coupling structure extend respectively; wherein each of the elbowed protrusions extend at an angle and distance sufficient to permit the first wall member and the second wall member to lay flat against each other without straining the coupling there between; and b) a second wall member substantially identical to the first wall member and selectably coupled thereto at their respective first and second coupling structures such that each first coupling structure is coupled to each second coupling structure; wherein the first wall member and the second wall member together form a cylindrical envelope having a top aperture and a bottom aperture; wherein the cylindrical envelope has a hexagonal cross-section.

* * * * *